United States Patent [19]

Cilley

[11] Patent Number: 4,917,812

[45] Date of Patent: Apr. 17, 1990

[54] GRANULAR AUTOMATIC DISHWASHER DETERGENT COMPOSITION PROVIDING GLASSWARE PROTECTION CONTAINING INSOLUBLE ZINC COMPOUND

[75] Inventor: William A. Cilley, Cincinnati, Ohio

[73] Assignee: The Procter & Gamble Company, Cincinnati, Ohio

[21] Appl. No.: 310,817

[22] Filed: Feb. 13, 1989

[51] Int. Cl.[4] ..... C11D 3/12; C11D 3/395

[52] U.S. Cl. ..... 252/99; 252/95; 252/135; 252/387

[58] Field of Search ..... 252/95, 99, 135, 387, 252/315.5

[56] References Cited

U.S. PATENT DOCUMENTS

| | | | |
|---|---|---|---|
| 4,017,410 | 4/1977 | Sorgenfrei et al. | 252/156 |
| 4,226,736 | 10/1980 | Bush et al. | 252/135 |
| 4,329,328 | 11/1982 | McAnespie et al. | 423/333 |
| 4,561,994 | 12/1985 | Rubin et al. | 252/187.23 |
| 4,714,562 | 12/1987 | Roselle et al. | 252/94 |

*Primary Examiner*—Prince E. Willis

*Attorney, Agent, or Firm*—Gretchen R. Hatfield; Donald E. Hasse; Thomas H. O'Flaherty

[57] ABSTRACT

Disclosed are granular automatic dishwashing detergent compositions containing an insoluble inorganic zinc salt useful for inhibition of glassware corrosion in the dishwasher. These compositions are particularly desirable because use of them in the dishwasher does not result in precipitation of zinc insolubles on the dishware or dishwasher parts.

18 Claims, No Drawings

GRANULAR AUTOMATIC DISHWASHER DETERGENT COMPOSITION PROVIDING GLASSWARE PROTECTION CONTAINING INSOLUBLE ZINC COMPOUND

TECHNICAL FIELD AND BACKGROUND ART

This invention relates to granular automatic dish washing detergent compositions containing insoluble inorganic zinc salts which are useful for inhibiting glassware corrosion in an automatic dishwasher.

Corrosion of glass in automatic dishwashers is a well known o phenomenon. A paper by D. Joubert and H. Van Daele entitled "Etching of Glassware in Mechanical Dishwashing" in Soap and Chemical Specialties, March, 1971, pp. 62, 64, and 67, discusses the influence of various detergent components, particularly those of an alkaline nature. This subject is also discussed in a paper entitled "The Present Position of Investigations Into the Behavior of Glass During Mechanical Dishwashing" presented by Th. Altenschoepfer in April, 1971, at a symposium in Charleroi, Belgium, on "The Effect of Detergents on Glassware in Domestic Dishwashers". See, also, another paper delivered at the same symposium by P. Mayaux entitled "Mechanism of Glass Attack by Chemical Agents".

It has been determined that the glassware corrosion problem actually consists of two separate phenomena; one is corrosion due to the leaching out of minerals from the glass composition itself together with hydrolysis of the silicate network, and the second is deposition and redeposition of silicate material onto the glass. It is a combination of the two that can result in the cloudy appearance of glassware that has been washed repeatedly in an automatic dishwasher. This cloudiness often manifests itself in the early stages as an iridescent film that becomes progressively more opaque with repeated washings.

Use of zinc, in general, in automatic dishwashing to prevent glass corrosion is not new. See for example, U.S. Pat. No. 3,677,820, Rutkowski, issued July 18, 1972, which discloses hanging a strip of metallic zinc in the dishwasher to prevent corrosion of glassware. U.S. Pat. No. 3,255,117, Knapp et al, issued June 7, 1966, discloses the use of soluble zinc salts in automatic dishwashing detergent compositions to prevent glassware corrosion. This reference states that introducing soluble metal salts (alkali aluminate, zincate, or berylliate) in automatic dishwashing detergent compositions can result in precipitation out of insoluble material. Such material is said to be very undesirable as it can adhere to dishwasher parts and dishware during the washing cycle. This precipitation is said to be avoided by carefully adjusting the levels and proportions of the various components in product formulation.

U.S. Pat. No. 3,350,318, Green, issued Oct. 31, 1967, also describes the use of soluble zinc salts (sodium aluminate, sodium zincate) to prevent attack by automatic dishwashing detergent compositions of overglaze colors and decorations on fine china and the aluminum of pots and pans. The problem of precipitate formation is discussed and said to be avoided by spraying a solution of the soluble zinc salt onto granular polyphosphate particles.

U.S. Pat. No. 2,575,576, Bacon et al, issued Nov. 20, 1951, describes the use of a water-soluble zinc or aluminum salt to prevent the corrosion of vitreous and ceramic surfaces. It is stated that the problem of compounding alkali metal salts such as sodium carbonates, -phosphates, -silicates, or -sulfates with water-soluble zinc or aluminum compounds is that an undesirable precipitate is formed. This problem is said to be overcome by the careful choice of particular components at particular ranges and proportions.

U.S. Pat. No. 3,755,180, Austin, issued Aug. 28, 1973, describes use of a precipitated silico-aluminate compound for inhibiting overglaze attack in china. Again, the problem of precipitate formation when soluble zinc and aluminum salts are utilized for this purpose is discussed. (See also U.S. Pat. No. 3,966,627, Gray, issued June 29, 1976.)

Despite these disclosures, there is a continuing need for granular automatic dishwashing detergent compositions which provide protection against glassware corrosion without causing the formation of insolubles in the dishwasher.

Accordingly, it is an object of the present invention to provide improved granular automatic dishwashing detergent compositions which provide protection against glassware corrosion without causing the formation of insolubles in the dishwasher which can adhere to dishwasher parts and dishware.

It has been surprisingly discovered that by utilizing certain insoluble inorganic zinc salts in granular automatic dishwashing compositions, the above objectives can be attained.

SUMMARY OF THE INVENTION

The present invention relates to granular automatic dishwashing detergent compositions which comprise:

(a) from about 0.1% to about 8.0% of a detergent surfactant;

(b) an amount of a chlorine bleach ingredient sufficient to provide the composition with from 0%, preferably from about 0.1%, to about 5.0% of available chlorine based on the weight of the detergent composition;

(c) from about 10% to about 80% of a detergency builder;

(d) an amount of an insoluble inorganic zinc salt having a maximum particle size less than about 1.7 millimeters, that will provide the composition with from about 0.02% to about 10.0% zinc.

DETAILED DESCRIPTION OF THE INVENTION

Insoluble Zinc Salt

The present invention provides a means for protecting glassware from corrosion in an automatic dishwashing process without the retention of insoluble material on dishware or dishwasher parts. The present invention provides this glassware protection by utilizing an insoluble inorganic zinc salt in a granular automatic dishwashing detergent composition. Without wishing to be bound by theory, it is believed that zinc present in the dishwashing process deposits onto the surface of the glass, thus inhibiting mineral leaching and silicate hydrolysis which would result in corrosion. It is also believed that the zinc inhibits the deposition of silicate onto glassware during the dishwashing process, resulting in glassware which remains clear in appearance for a longer period of time than glassware which has not been treated with zinc. This treatment does not completely prevent the corrosion of glassware in the automatic dishwasher. It protects glassware against corrosion and allows glassware to remain essentially uncorroded for a longer period of time. For example, the onset of discoloration of the glass may be delayed for about twice as long as is seen with untreated glass. Hence, treatment with zinc slows down the corrosion process.

Because the zinc is in a form in product which is essentially insoluble, the amount of precipitate which will form in the dishwashing process is greatly reduced. The insoluble inorganic zinc salt will dissolve only to a limited extent, hence chemical reaction of dissolved species in the dishwashing process is controlled. Thus, use of zinc in this form allows for control of the release of reactive zinc species and precipitation of insolubles of a large and uncontrolled size in the dishwasher.

Likewise, when the zinc is in an insoluble form, the likelihood of formation of larger, more troublesome insoluble particles (due to mobilization by moisture) is reduced on product storage.

It has surprisingly been discovered that zinc in this insoluble form provides glassware corrosion inhibition equivalent to that provided by soluble zinc salts.

By insoluble inorganic zinc salt is meant an inorganic zinc salt which has a solubility in water of less than 1 gram of zinc salt in 100 mls of water.

Examples of zinc salts which meet this criterion, and hence are covered by the present invention, are zinc silicate, zinc carbonate, zinc oxide, zinc basic carbonate (approximately $Zn_2(OH)_2CO_3$), zinc hydroxide, zinc oxalate, zinc monophosphate ($Zn_3(PO_4)_2$), and zinc pyrophosphate ($Zn_2(P_2O_7)$).

The level of insoluble zinc salt necessary to achieve the glassware protection benefit of the present invention is an amount that provides the composition with a total level of zinc between about 0.02% and about 10.0%, preferably between about 0.1% and about 5.0%, most preferably between about 0.2% and about 1.0%. An amount less than about 0.02% zinc is insufficient to provide the desired protection against glassware corrosion. An amount greater than 10.0% may result in undesirable insoluble formation in the dishwasher. The exact level of zinc salt to be used will depend somewhat on the particular insoluble inorganic zinc salt chosen for use in the composition. The more insoluble the salt, the greater amount necessary to achieve the same level of benefit. This is because less zinc will solubilize in the dishwasher and become available for treatment of the glassware.

The remainder of the dishwashing composition formulation will also affect efficacy of the insoluble inorganic zinc salt in delivering glassware protection. For example, the more caustic the composition, the more insoluble inorganic zinc salt will be necessary to get the same level of protection that would be seen with a less caustic formula. For compositions with higher levels of builder components, a higher level of insoluble inorganic zinc salt will be needed to achieve the same glassware protection benefit that would be seen with formulas having lower levels of builder material.

Since most of the insoluble zinc material will remain in essentially the same form throughout the dishwashing process, it is important that the particle size of the insoluble inorganic zinc salt be small enough so that the material will pass through the dishwashing process without adhering to dishware or dishwasher parts. If the maximum particle size of the insoluble zinc salt is kept below 1.7 millimeters, insolubles in the dishwasher should not be a problem. Preferably, the insoluble inorganic zinc salt material has an average particle size even smaller than this to insure against insolubles on dishware in the dishwasher, e.g., an average size smaller than about 250 microns. This is especially true when high levels of insoluble inorganic zinc salts are utilized. Furthermore, the smaller the particle size, the more efficient the insoluble inorganic zinc salt in protecting glassware. If a very low level of insoluble inorganic zinc salt is utilized, it is most desirable to use material having a very small particle size, e.g., smaller than about 100 microns. For the very insoluble inorganic zinc salts, a smaller particle size may be necessary to get the desired efficacy for glassware protection. For example, with zinc oxide, a desired particle size might be less than about 100 microns.

DETERGENCY BUILDER MATERIAL

Compositions of the invention contain from about 10% to about 80%, preferably from about 40% to about 70%, by weight of detergency builder component, or mixtures thereof, said percentages being determined on an anhydrous basis although the builders can be hydrated.

The detergency builder material can be any of the detergent builder materials known in the art which include trisodium phosphate, tetrasodium pyrophosphate, sodium tripolyphosphate, sodium hexametaphosphate, sodium silicates having $SiO_2$:$Na_2O$ weight ratios of from about 1:1 to about 3.6:1, sodium carbonate, sodium hydroxide, sodium citrate, borax, sodium ethylenediaminetetraacetate, sodium nitrilotriacetate, sodium carboxymethyloxysuccinate, sodium carboxymethyloxymalonate, polyphosphonates, salts of low molecular weight carboxylic acids, and polycarboxylates, polymeric carboxylates such as polyacrylates, and mixtures thereof.

Preferred detergency builder materials have the ability to remove metal ions other than alkali metal ions from washing solutions by sequestration, which as defined herein includes chelation, or by precipitation reactions. Sodium tripolyphosphate is a particularly preferred detergency builder material which is a sequestering agent. Sodium carbonate is a preferred precipitation detergency builder, particularly when it is desirable to reduce the total phosphorus level of the compositions of the invention. Chlorinated trisodium orthophosphate can act as both a chlorine bleach and a precipitation detergency builder material.

The inclusion of water-soluble silicates, especially sodium silicates having $SiO_2$:$Na_2O$ weight ratios of from about 1:1 to about 3.6:1 is a particularly preferred embodiment of the invention.

Builder materials are one of the causes of glassware corrosion in the dishwasher. Hence, it may be desirable to keep the total level of builder in the composition at a reasonably low level.

Particularly preferred compositions of the present invention contain from about 15% to about 35% sodium tripolyphosphate, from about 5% to about 10% of sodium silicate solids as described hereinbefore, and from about 10% to about 35% sodium carbonate by weight.

Chlorine Bleach Component

The compositions of the invention can contain an amount of a chlorine bleach ingredient sufficient to provide the composition with from 0%, preferably from about 0.1%, to about 5.0%, most preferably from about 0.5% to about 3.0%, of available chlorine based on the weight of the detergent composition.

An inorganic chlorine bleach ingredient such as chlorinated trisodium phosphate can be utilized, but organic chlorine bleaches such as the chlorocyanurates are preferred. Water-soluble dichlorocyanurates such as sodium or potassium dichloroisocyanurate dihydrate are particularly preferred.

Methods of determining "available chlorine" of compositions incorporating chlorine bleach materials such as hypochlorites and chlorocyanurates are well known in the art. Available chlorine is the chlorine which can be liberated by acidification of a solution of hypochlorite ions (or a material that can form hypochlorite ions in solution) and at least a molar equivalent amount of chloride ions. A conventional analytical method of determining available chlorine is addition of an excess of an iodide salt and titration of the liberated free iodine with a reducing agent.

The Surfactant

The compositions of the invention contain from about 0.1% to about 8.0%, more preferably from about 0.5% to about 5.0%, of preferably low-foaming, bleach-stable surfactant. Nonionic surfactants are preferred, especially those which are solid at 35° C. (95° F.), more preferably those which are solid at 25° C. (77° F.). Reduced surfactant mobility is a consideration in stability of the bleach component. Preferred surfactant compositions with relatively low solubility can be incorporated in compositions containing alkali metal dichlorocyanurates or other organic chlorine bleaches without an interaction that results in loss of available chlorine. The nature of this problem is disclosed in U.S. Pat. No. 4,309,299 issued Jan. 5, 1982 to Rapisarda et al and in U.S. Pat. No. 3,359,207, issued Dec. 19, 1967, to Kaneko et al, both patents being incorporated herein by reference.

In a preferred embodiment the surfactant is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkylphenol on an average basis.

A particularly preferred ethoxylated nonionic surfactant is derived from a straight chain fatty alcohol containing from about 16 to about 20 carbon atoms ($C_{16-20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The ethoxylated nonionic surfactant can optionally contain propylene oxide in an amount up to about 15% by weight of the surfactant and retain the advantages hereinafter described. Preferred surfactants of the invention can be prepared by the processes described in U.S. Pat. No. 4,223,163, issued Sept. 16, 1980, Guilloty, incorporated herein by reference.

The most preferred composition contains the ethoxylated monohydroxyalcohol or alkyl phenol and additionally comprises a polyoxyethylene, polyoxypropylene block polymeric compound; the ethoxylated monohydroxy alcohol or alkyl phenol nonionic surfactant comprising from about 20% to about 80%, preferably from about 30% to about 70%, of the total surfactant composition by weight.

Suitable block polyoxyethylene-polyoxypropylene polymeric compounds that meet the requirements described hereinbefore include those based on ethylene glycol, propylene glycol, glycerol, trimethylolpropane and ethylenediamine as the initiator reactive hydrogen compound. Polymeric compounds made from a sequential ethoxylation and propoxylation of initiator compounds with a single reactive hydrogen atom, such as $C_{12-18}$ aliphatic alcohols, do not provide satisfactory suds control in the detergent compositions of the invention. Certain of the block polymer surfactant compounds designated PLURONIC and TETRONIC by the BASF-Wyandotte Corp., Wyandotte, Mich., are suitable in the surfactant compositions of the invention.

Because of the relatively high polyoxypropylene content, e.g., up to about 90% of the block polyoxyethylene-polyoxypropylene polymeric compounds of the invention and particularly when the polyoxypropylene chains are in the terminal position, the compounds are suitable for use in the surfactant compositions of the invention and have relatively low cloud points. Cloud points of 1% solutions in water are typically below about 32° C. and preferably from about 15° C. to about 30° C. for optimum control of sudsing throughout a full range of water temperatures and water hardnesses.

Anionic surfactants including alkyl sulfonates and sulfates containing from about 8 to about 20 carbon atoms; alkyl benzene sulfonates containing from about 6 to about 13 carbon atoms in the alkyl group, and the preferred low-sudsing mono- and/or dialkyl phenyl oxide mono- and/or di-sulfonates wherein the alkyl groups contain from about 6 to about 16 carbon atoms are also useful in the present invention. All of these anionic surfactants are used as stable salts, preferably sodium and/or potassium.

Other bleach-stable surfactants include trialkyl amine oxides, betaines, etc. such surfactants are usually high sudsing. A disclosure of bleach-stable surfactants can be found in published British Patent Application No. 2,116,199A; U.S. Pat. No. 4,005,027, Hartman; U.S. Pat. No. 4,116,851, Rupe et al; and U.S. Pat. No. 4,116,849, Leikhim, all of which are incorporated herein by reference.

The preferred surfactants of the invention in combination with the other components of the composition provide excellent cleaning and outstanding performance from the standpoints of residual spotting and filming. In these respects, the preferred surfactants of the invention provide generally superior performance relative to ethoxylated nonionic surfactants with hydrophobic groups other than monohydroxy alcohols and alkylphenols, for example, polypropylene oxide or polypropylene oxide in combination with diols, triols and other polyglycols or diamines.

Alkyl Phosphate Ester

The automatic dishwashing compositions of the invention can optionally contain up to about 50%, preferably from about 2% to about 20%, based on the weight of ethoxylated nonionic surfactant of alkyl phosphate ester or mixtures thereof and wherein the alkyl preferably contains from about 16 to about 20 carbon atoms.

Suitable alkyl phosphate esters are disclosed in U.S. Pat. No. 3,314,891, issued Apr. 18, 1967, to Schmolka et al, incorporated herein by reference.

The preferred alkyl phosphate esters contain from 16–20 carbon atoms. Highly preferred alkyl phosphate esters are monostearyl acid phosphate and monooleyl acid phosphate, or salts thereof, particularly alkali metal salts, or mixtures thereof.

The alkyl phosphate esters of the invention have been used to reduce the sudsing of detergent compositions suitable for use in automatic dishwashing machines. The esters are particularly effective for reducing the sudsing of compositions comprising nonionic surfactants which are heteric ethoxylated-propoxylated or block polymers of ethylene oxide and propylene oxide.

Optional Ingredients

Filler materials can also be present including sucrose, sucrose esters, sodium chloride, sodium sulfate, etc., in amounts from about 0.001% to about 60%, preferably from about 5% to about 30%.

Hydrotrope materials such as sodium benzene sulfonate toluene sulfonate, sodium cumene sulfonate, etc., can be present in minor amounts.

Bleach-stable perfumes (stable as to odor); bleach-stable dyes (such as those disclosed in U.S. Pat. No. 4,714,562, Roselle et al, issued Dec. 22, 1987); and crystal modifiers and the like can also be added to the present compositions in minor amounts.

Granular Detergent Composition Formation

The detergent compositions of the present invention are not restricted as to manner of preparation. The granular compositions can be prepared in any manner that results in formation of a granular product form. The process described in U.S. Pat. No. 2,895,916 issued July 21, 1959, to Milenkevich et al, and variations thereof, are particularly suitable. Also particularly described in U.S. Pat. No. 4,427,417, issued Jan. 24, 1984, to Porasik. Both of these patents are incorporated herein by reference.

Incorporation of Zinc Salt Into Base Composition

Any method of incorporating the insoluble inorganic zinc salt into the granular automatic dishwashing detergent composition which will result in maintenance of an insoluble inorganic zinc salt average particle size of less than 250 microns may be used in the present invention.

The insoluble inorganic zinc salt may be simply admixed, as is, into the finished granular automatic dishwashing detergent product. However, this method may result in segregation out of the zinc material during shipping and handling due to the smaller particle size of the zinc material relative to the base granules. Alternatively, the insoluble inorganic zinc salt may be incorporated into the granular automatic dishwashing detergent composition via an agglomeration process wherein insoluble inorganic zinc salt particles which have an average particle size of less than 250 microns are agglomerated with a water-soluble agglomerating substance to result in particles which are about the same size as typical automatic dishwashing detergent granules. These agglomerates of the insoluble inorganic zinc salt particles can then be simply mixed in with the preformed detergent granules. More specifically, agglomeration of the zinc material is accomplished by combining the material with an agglomerating material and then hydrating the materials by spraying on water to form an agglomerate. A Schugi agglomerator/fluid bed, a spray dryer, a mix drum with a spray nozzle insert, or any other equipment suitable for agglomerating, may be used to form the agglomerates of insoluble inorganic zinc salt. Any water-soluble agglomerating material may be used which would render the desired agglomerate integrity. Non-limiting examples of useful binder materials include alkali metal phosphates or carbonates and the organic agglomerating agents disclosed in U.S. Pat. No. 4,141,841, McDonald, issued Feb. 27, 1979, incorporated herein by reference.

The amount of water used to form the agglomerate will vary depending on the degree of hydration and the agglomerate size desired. The level of agglomerating material in the agglomerate will vary depending on the desired size of the agglomerate and the amount of insoluble inorganic zinc salt to be incorporated therein. Typically, the agglomerate will comprise from about 1% to about 90% agglomerating material, from about 10% to about 30% water, and from about 1% to about 90% insoluble inorganic zinc material. A preferred execution has levels as follows: about 60% agglomerating material, about 22% water, and about 18% insoluble inorganic zinc salt.

Alternatively, the insoluble inorganic zinc salt may be formed into a prill. Any water-soluble polymer can be used as a binder to form the prill. Such a procedure would involve dispensing the zinc material into a molten polymer or polymer solution and then spray drying the mixture. Polyethylene glycol is an example of a water-soluble polymer which may be used to make such a prill. Generally, the polymer will comprise from about 10% to about 90% of the prill composition.

Alternative ways of adding the insoluble inorganic zinc salt to product might be to add the salt as part of the product process. For example, the insoluble inorganic zinc salt could be added to the sodium tripolyphosphate in a hydrating step prior to producing the base product agglomerate. Alternatively, the insoluble inorganic zinc salt could be added with hydrated sodium tripolyphosphate, sodium sulfate, and sodium carbonate in the base product agglomerating step.

An alternative method for producing granular automatic dishwashing detergent compositions of the present invention involves forming the insoluble inorganic zinc salt in-process.

As with the use of preformed insoluble inorganic zinc salts having a small particle size, this alternative process involves control of the zinc particle size and species form to prevent formation of undesirable insoluble material during the dishwashing process.

Such a method would involve forming a stable colloidal dispersion of an insoluble inorganic zinc salt in an aqueous sodium silicate solution. The particle size of the insoluble inorganic zinc salt dispersed in the silica colloid remains less than 1 micron. Hence, use of an insoluble inorganic zinc salt in this form in the dishwashing process will not result in insolubles on dishwasher parts or dishware. More specifically, the method would involve first dissolving a soluble zinc salt in an amount of water just sufficient to dissolve the salt. Nonlimiting examples of soluble zinc salts useful in this method include zinc acetate, zinc acetate dihydrate, zinc chloride, zinc bromide, zinc iodide, zinc butyrate, zinc caproate, zinc formate, zinc formate dihydrate, zinc lactate, zinc salicylate, zinc nitrate, zinc nitrate trihydrate, zinc nitrate hexahydrate, zinc sulfate monohydrate, zinc sulfate heptahydrate, sodium zincate, and zinc tripolyphosphate. The zinc salt solution is then added slowly at a point of high shear to an aqueous sodium silicate solution using high shear mixing equipment. Examples of useful equipment include a WARING Blender on a lab scale and a PREMIER dispersator or a Ross high shear mixer, on a larger scale. Mixing should be carried out at high shear speeds, for example, about 7000–8000 rpm. The sodium silicate solution used to make the present compositions comprises sodium silicate having an $SiO_2$:$Na_2O$ weight ratio of from about 1:1 to about 3.6:1 in water at about 40–50% wt. % sodium silicate solids. Mixing should continue long enough to assure a homogeneous dispersion of the zinc salt in the silicate solution. The initial turbidity of the starting silicate slurry should not be appreciably changed. To avoid precipitate formation, the molar ratio of zinc metal to $SiO_2$ in the colloidal dispersion formed should not exceed about 0.1:1. Preferably, the molar ratio of zinc metal to $Si_2$ in the colloidal dispersion formed is from about 0.01:1 to about 0.1:1; most preferably the molar ratio is from about 0.02:1 to about 0.08:1.

It is believed that very fine particles, probably much smaller than about 1 micron, of insoluble zinc silicate are formed via this process which are dispersed in, and remain stable in, the silica colloid formed.

This colloidal dispersion can then be used in any granular automatic dishwashing detergent making process, in place of the silicate slurry, to produce product.

Preferred Compositions

Preferred granular automatic dishwashing detergent compositions of the present invention are as follows:

(a) from about 15% to about 35% of tripolyphosphate;
(b) from about 10% to about 35% of sodium carbonate;
(c) from about 5% to about 10% of sodium silicate solids having an $SiO_2$:$Na_2O$ ratio of from about 1.6 to about 3.2;
(d) from about 0.5% to about 5.0% of an ethoxylated propoxylated nonionic surfactant;
(e) from about 1.0% to about 5.0% of a chlorocyanurate; and
(f) from about 0.2% to about 1.0% of zinc carbonate having an average particle size of less than 100 microns.

Method of Use

The present compositions are used in the typical way to wash dishes in an automatic dishwasher. The compositions are formulated with sufficient insoluble inorganic zinc salt material so that when a unit dose of the composition is used in the wash cycle of the automatic dishwashing process, glassware corrosion inhibition is achieved.

As used herein, all percentages, parts and ratios are by weight unless otherwise stated.

The following Examples illustrate the invention and facilitate its understanding.

EXAMPLE I

A silica colloid having fine particles of insoluble zinc silicate dispersed therein is prepared as follows:

| Component | Wt. % |
|---|---|
| Sodium silicate (2.4 R) slurry (~45% solids) | 81.8 |
| $ZnSO_4.7H_2O$ (dry powder) | 7.6 |
| Distilled water | 10.6 |

The $ZnSO_4.7H_2O$ is first dissolved in the distilled water. The silicate slurry is placed into the stainless steel container of a Waring commercial blender. The blender is set on low speed, and the $ZnSO_4.7H_2O$ solution is slowly added to the silicate slurry in the blender at 1–2 ml/sec. The components are then blended on high speed for 60 seconds.

It is believed that very fine particles (i.e., less than 1 micron in size) of insoluble zinc silicate are formed during the process which are dispersed in the silica colloid formed. This silica colloid can be used to prepare granular automatic dishwashing detergent compositions which, when used in the dishwasher, will inhibit glassware corrosion.

Other silica colloids useful in the compositions of the present invention are obtained if the zinc sulfate heptahydrate is replaced in whole or in part with another soluble zinc salt.

EXAMPLE II

A granular automatic dishwashing detergent composition of the present invention is as follows:

| Component | Wt % |
|---|---|
| Silica colloid of Example I (8.5% silicate solids/0.4% zinc) | 23.1 |
| Sodium tripolyphosphate | 33.0 |
| Sodium sulfate | 18.75 |
| Sodium carbonate | 20.0 |
| Available chlorine from sodium dichlorocyanurate dihydrate (2.5%) | 1.4 |
| Nonionic surfactant* | 2.5 |
| Monostearyl acid phosphate (suds suppressor) | 0.1 |
| Perfume, dye, and water | To 100% |

*Ethoxylated monohydroxy alcohol or alkyl phenol.

The composition is prepared as follows. Two Schugi agglomerators and a fluid bed are used to make product. The first Schugi agglomerator is used to convert sodium tripolyphosphate to high levels of sodium tripolyphosphate hexahydrate intermediate in the presence of the nonionic surfactant. The second Schugi agglomerator is used to form the product granules from the sodium tripolyphosphate intermediate, the sodium sulfate, and the sodium carbonate, using the silica colloid having the fine dispersion of zinc silicate therein. The fluid bed is used to dry the agglomerate. Bleach is dry added to product as an admix.

Use of this automatic dishwashing detergent composition will inhibit corrosion of glassware in the dishwashing process.

EXAMPLE III

A granular automatic dishwashing detergent composition of the present invention is as follows:

| Component | Wt % |
|---|---|
| Sodium tripolyphosphate | 33.17 |
| Sodium carbonate | 29.00 |
| Sodium sulfate | 12.04 |
| Sodium dichlorocyanurate dihydrate (av. $Cl_2$ = 0.28–2.8%) | 2.50 |
| Silicate solids (ratio = 1.6–3.2) | 8.50 |
| Nonionic surfactant* | 2.60 |
| Zinc carbonate** (0.4% zinc) | 0.80 |
| Perfume, dye, and water | To 100% |

*Blend of ethoxylated monohydroxy alcohol and polyoxyethylene/polyoxypropylene block polymer.
**Average particle size is less than 100 microns.

The composition is prepared as follows. Two Schugi agglomerators and a fluid bed are used to make the base product granules. One Schugi agglomerator is used to convert sodium tripolyphosphate to high levels of sodium tripolyphosphate hexahydrate intermediate in the presence of the nonionic surfactant. A second Schugi agglomerator is used to form the product granules from the sodium tripolyphosphate intermediate, sodium sulfate, and sodium carbonate (dry powders), using an aqueous sodium silicate solution. The fluid bed is used to dry the agglomerate. The bleach is dry added to the product as an admix.

The zinc carbonate having an average particle size of less than 100 microns is added to the base product as follows. The zinc carbonate may simply be admixed to product as is. However, because of the smaller particle size of the zinc carbonate relative to the granules, the zinc carbonate is preferably agglomerated with a binder material to form granules of about the same size as the base product granules. This will aid in prevention of segregation out of the zinc material during shipping and handling. The agglomerated zinc carbonate is formed as follows. Eight grams of the insoluble zinc salt particulate are combined with 33 grams of sodium tripolyphosphate. The mixture is then hydrated using a Schugi agglomerator by spraying on water to form an agglomerate. The ratio of dry powder material to water should be from about 5:1 to about 6:1.

Use of this automatic dishwashing detergent composition will inhibit corrosion of glassware in the dishwashing process.

Other compositions of the present invention can be achieved if the zinc carbonate is replaced in whole or in part with an alternative insoluble inorganic zinc salt selected from the group consisting of zinc silicate, zinc basic carbonate, zinc oxide, zinc hydroxide, zinc oxalate, zinc monophosphate, zinc pyrophosphate, and mixtures thereof, wherein the material has an average particle size of less than 100 microns.

Other compositions of the present invention can be achieved if twice the amount of zinc carbonate is used.

What is claimed is:

1. A granular automatic dishwashing detergent composition comprising:

(a) from about 0.1% to about 8.0% of a detergent surfactant;

(b) an amount of a chlorine bleach ingredient sufficient to provide the composition with from 0% to about 5.0% of available chlorine based on the weight of the detergent composition;

(c) from about 10% to about 80% of a detergency builder material;

(d) an amount of an insoluble inorganic zinc compound having a maximum particle size of less than about 1.7 millimeters that will provide the composition with from about 0.02% to about 10.0% zinc.

2. The composition of claim 1 wherein the average particle size of the insoluble inorganic zinc compound is less than about 250 microns.

3. The composition of claim 2 comprising an amount of the insoluble inorganic zinc compound that will provide the composition with from about 0.1% to about 5.0% zinc.

4. The composition of claim 3 wherein the insoluble inorganic zinc compound is selected from the group consisting of zinc silicate, zinc carbonate, zinc basic carbonate, zinc oxide, zinc hydroxide, zinc monophosphate, zinc pyrophosphate, and mixtures thereof.

5. The composition of claim 4 wherein the insoluble inorganic zinc compound is zinc carbonate and has an average particle size less than 100 microns.

6. The composition of claim 1 wherein the detergency builder material is selected from the group consisting of sodium tripolyphosphate, sodium carbonate, sodium silicate, hydrates thereof, and mixtures thereof.

7. The composition of claim 1 wherein the chlorine bleach ingredient comprises a chlorocyanurate.

8. The composition of claim 1 wherein the detergent surfactant comprises a low-foaming, bleach-stable nonionic surfactant.

9. A granular automatic dishwashing detergent composition comprising:

(a) from about 15% to about 35% of tripolyphosphate;

(b) from about 10% to about 35% of sodium carbonate;

(c) from about 5% to about 10% of sodium silicate solids having an $SiO_2$:$Na_2O$ ratio of from about 1.6 to about 3.2;

(d) from about 0.5% to about 5.0% of an ethoxylated propoxylated nonionic surfactant;

(e) from about 1.0% to about 5.0% of a chlorocyanurate; and (f) from about 0.2% to about 1.0% of zinc carbonate having an average particle size of less than 100 microns.

10. A method for preparing an automatic dishwashing detergent composition comprising;

(a) high shear mixing of an aqueous solution of soluble silicate with an aqueous solution of a soluble zinc salt, at a molar ratio of zinc metal to $SiO_2$ of less than about 0.1:1, to prepare a silica colloid having a dispersion of zinc silicate particles therein which have an average size of less than about 1 micron; and (b) using the colloidal suspension of (a) to prepare a granular automatic dishwashing detergent composition.

11. The method of claim 10 wherein the molar ratio of zinc metal to $SiO_2$ is from about 0.01 to about 0.1.

12. The method of claim 11 wherein the soluble zinc salt is selected from the group consisting of zinc sulfate, zinc acetate, zinc acetate dihydrate, zinc chloride, zinc bromide, zinc iodide, zinc butyrate, zinc caproate, zinc formate, zinc formate dihydrate, zinc lactate, zinc salicylate, zinc nitrate, zinc nitrate trihydrate, zinc nitrate hexahydrate, zinc sulfate monohydrate, zinc sulfate heptahydrate, sodium zincate, zinc tripolyphosphate, and mixtures thereof.

13. The method of claim 12 wherein the molar ratio of zinc metal to $SiO_2$ is from about 0.02:1 to about 0.08:1.

14. The method of claim 13 wherein the soluble zinc salt is selected from the group consisting of zinc sulfate monohydrate, zinc sulfate heptahydrate and sodium zincate.

15. The product of the process of claim 10.

16. A method for glassware corrosion inhibition in an automatic dishwashing process comprising contacting the glass with wash water containing an effective amount of the composition of claim 1.

17. A method for glassware corrosion inhibition in an automatic dishwashing process comprising contacting the glass with wash water containing an effective amount of the composition of claim 4.

18. A method for glassware corrosion inhibition in an automatic dishwashing process comprising contacting the glass with wash water containing an effective amount of the composition of claim 9.

* * * * *